US006020300A

United States Patent [19]

Tcheou et al.

[11] Patent Number: 6,020,300

[45] Date of Patent: Feb. 1, 2000

[54] COMPOSITION FOR TREATING STAINS ON LAUNDRY ITEMS AND METHODS OF TREATMENT

[75] Inventors: Eric Tcheou, Brussels; Jose Luis Vega, Strombeek-Bever, both of Belgium

[73] Assignee: The Procter & Gamble Company, Cincinnati, Ohio

[21] Appl. No.: 09/077,380

[22] PCT Filed: Sep. 16, 1996

[86] PCT No.: PCT/US96/14772

§ 371 Date: Jul. 29, 1998

§ 102(e) Date: Jul. 29, 1998

[87] PCT Pub. No.: WO94/20095

PCT Pub. Date: Jul. 5, 1999

[51] Int. Cl.[7] ..... C11D 1/72; C11D 1/83; C11D 3/395; C11D 3/43

[52] U.S. Cl. ..... 510/417; 510/277; 510/283; 510/284; 510/311; 510/313; 510/337; 510/338; 510/340; 510/342; 510/357; 510/356; 510/376; 510/407; 510/417; 510/421; 510/423; 510/424; 510/426; 510/427; 510/432

[58] Field of Search ..... 510/277, 283, 510/284, 311, 313, 337, 338, 340, 342, 351, 356, 376, 407, 417, 421, 423, 424, 426, 427, 432

[56] References Cited

U.S. PATENT DOCUMENTS

| | | | |
|---|---|---|---|
| 4,199,482 | 4/1980 | Renaud et al. | 510/284 |
| 4,412,934 | 11/1983 | Chung et al. | 252/186.38 |
| 4,634,551 | 1/1987 | Burns et al. | 510/313 |
| 4,772,413 | 9/1988 | Massaux et al. | 8/137 |
| 4,915,854 | 4/1990 | Mao et al. | 510/296 |
| 4,954,286 | 9/1990 | Sepulveda et al. | 510/284 |
| 5,205,960 | 4/1993 | Kristopeit et al. | 510/284 |
| 5,576,282 | 11/1996 | Miracle et al. | 510/276 |

FOREIGN PATENT DOCUMENTS

| | | | |
|---|---|---|---|
| 1 518 676 | 7/1978 | United Kingdom | C11D 10/02 |

OTHER PUBLICATIONS

Archer, Wesley L., *Industrial Solvents Handbook*, Marcel Dekker, Inc., 1996. pp. 40–41. TP247.5.A73, 1996.

*Primary Examiner*—Yogendra Gupta
*Assistant Examiner*—Gregory R. Delcotto
*Attorney, Agent, or Firm*—Jacobus C. Rasser; Kim W. Zerby; Pankaj M. Khosla

[57] ABSTRACT

The present invention relates to a cleaning composition which is an oil-in-water or water-in-oil emulsion, or a solution comprising non-aqueous hydrophobic solvent; and anionic or nonionic surfactant. The cleaning composition further comprises a bleach activator. The invention also relates to a method for treating a spot or stain on a textile fabric using the cleaning composition.

6 Claims, No Drawings

COMPOSITION FOR TREATING STAINS ON LAUNDRY ITEMS AND METHODS OF TREATMENT

The present invention relates to compositions for treating stains on laundry items. Laundry items can be treated either before or after a conventional laundering process by application of the composition in the region of the stain so that the stain is at least partially released and removal of the stain is made easier.

Emulsions of solvent-aqueous systems are known to be effective as spot pretreating compositions on both hydrophobic and hydrophilic stains.

GB-A-2 194 547, published on 9th Mar. 1988, discloses mixtures of n-dodecane with both short-chain (Neodol 91-6) and long chain (Neodol 45-1) nonionics. The compositions are in the form of liquid solutions; water-in-oil or oil-in-water microemulsions, or gels. However this application does not disclose compositions which comprise bleach activator material.

The present invention relates to a cleaning composition which is an oil-in-water or water-in-oil emulsion, or a solution comprising non-aqueous hydrophobic solvent; and anionic or nonionic surfactant.

It is the objective of the present invention to improve the removal of bleachable stains through the application of the composition of the present invention and the application of a bleaching compound, preferably a peroxide compound.

SUMMARY OF THE INVENTION

The objective of the present invention is achieved by providing a cleaning composition which further comprises a bleach activator so that cleaning performance for bleachable stains is enhanced. Preferably the bleach activator is at a level of from 0.1% to 10% by weight of the cleaning composition. Preferably water is at a level of from 5% to 95% by weight of the composition.

The invention also relates to a method for treating a spot or stain on a textile fabric using the cleaning compositions of the invention.

DETAILED DESCRIPTION OF THE INVENTION

Hydrophobic solvents are an essential feature of the compostions of the present invention. Preferred hydrophobic solvents are defined in terms of Hansen parameters. A hydrophobic solvent as defined herein is considered to be a solvent having Hansen hydrogen bonding cohesion parameter dH below 18 $(\text{Joule/cm}^3)^{0.5}$. Preferred hydrophobic solvents have a Hansen hydrogen bonding cohesion parameter dH below 12 $(\text{Joule/cm}^3)^{0.5}$ and a Hansen polar parameter dP below 8 $(\text{Joule/cm}^3)^{0.5}$.

Preferred solvents for use comprise mixtures of hydrocarbons with a flash point no lower than 70° C., an initial boiling point no lower than 1300° C., preferably no lower than 145° C. and a solidification point not above 20° C. and aliphatic fatty acid esters. More preferred solvents would be alkanes or alkenes with a chain length above C7, and particularly alkanes and alkenes with an average of C8 to C20 atoms. Particularly preferred hydrophobic solvents are deodorised kerosine; solvent naphta; chlorinated hydrocarbons; and terpenes. Even more preferred are paraffins; isoparaffins; naphthenes; aromatics; olefins; 1,1,1-trichloroethane; perchloroethylene; methylene chloride; Shellsol SS® mixture (C8–C11 isoparaffin+5% aliphatic C7 ester); D-Limonene; and Glidsafe® supplied by Glidsol.

Solvents are used in the detergent compositions of the present invention preferably at a level of from 3% to 90%, more preferably from 4% to 45%, and most preferably from 5% to 25% by weight of the detergent composition.

In a preferred embodiment, the solvent comprises hydrocarbons with a flash point of not less than 70° C., an initial boiling point of greater than 145° C., and a solidification point of less than 20° C. The solvent is selected from the group consisting of $C_{10}$–$C_{18}$ linear or branched alkanes, terpene or mixtures thereof.

Other solvents having a Hansen parameter of dH less than 18 $(\text{Joule/cm}^3)^{0.5}$ include glycol ethers, more preferably glycol ethers based upon ethylene oxide, propylene oxide, or mixtures thereof. Particularly preferred are ethylene glycol monoethyl ether; Propylene glycol monomethyl ether; 2-butoxy ethanol; butyl diethylene glycol ether ethanol; butoxytriglycol; butylene glycol; hexylene glycol; and propyl propanol. Such solvents may, and preferably are, used in combination with either short chain surfactants, long chain surfactants, or mixtures thereof.

By "short-chain" what is meant herein is surfactants which comprise a $C_6$–$C_{11}$ alkyl chain as their hydrophobic portion. The first surfactant has an alkyl chain, the length of the alkyl chain being C11 or less. Such short-chain surfactants are accordingly those conventionally used in this field, but with a shorter alkyl chain, and can be of any type. Accordingly, suitable short chain surfactants for use herein include $C_6$–$C_{11}$ alkyl sulfates ($C_6$–$C_{11}SO_4$), alkyl ether sulfates ($C_6$–$C_{11}$ $(OCH_2CH_2)eSO_4$), alkyl sulfonates ($C_6$–$C_{11}SO_3$), alkyl succinates ($C_6$–$C_{11}OOCCH_2CH_2COOZ$), alkyl carboxylates ($C_6$–$C_{11}COOM$), alkyl ether carboxylates ($C_6$–$C_{11}$ $(OCH_2CH_2)eCOOM$), alkyl sarcosinates ($C_6$–$C_{11}CON(CH_3)R$), alkyl sulfo succinates ($C_6$–$C_{11}OOCCH(SO_3M)CH_2COOZ$), amine oxides ($C_6$ –$C_{11}RR'NO$), glucose amides ($C_6$–$C_{11}CONR''X$), alkylpyrrolidones ($C_6$–$C_{11}$ $(C_4H_6ON)$, alkylpolysaccharides ($C_6$–$C_{11}OGg$), alkyl alkoxylates ($C_6$–$C_{11}$ $(OCH_2CH_2)e(OCH_2CH_2CH_2)pOH$) and betaines ($C_6$–$C_{11}N+(CH_3)_2CH_2COO$—). In the formulae in brackets, e and p are independently from 0 to 20 and e+p>0, Z is M or R, N is H or any counterion such as those known in the art, including Na, K,Li, $NH_4$, and amine, X is a polyhydroxyhydrocarbyl having a linear hydrocarbyl chain with at least 3 hydroxyls directly connected to the chain, or an alkoxylated derivative thereof; R, R' and R'' are $C_1$–$C_5$ alkyl groups, possibly functionalized with hydroxyl groups; R and R' are preferably $C_1$–$C_3$, most preferably methyl; R'' is preferably 2-hydroxyethyl or 2 hydroxypropyl; G is saccharide, preferably glucose, and g is of from 1.5 to 8. All these surfactants are well known in the art. A more complete disclosure of conventional glucose amides can be found for instance in WO 92-06154 and a more complete disclosure of conventional alkyl polysaccharides can be found for instance in U.S. Pat. No. 4,536,319. The compositions according to the present invention may comprise any of the above surfactants alone, or any combination thereof.

Preferred short chain nonionic surfactants for use herein are alkyl alkoxylates according to the formula $C_6$–$C_{11}$ $(OCH_2CH_2)_e(OCH(CH_3)CH_2)_pOH$, where e and p representing respectively the degree of ethoxylation and propoxylation, are independently of from 0 to 20, and that e+p>0. Most preferred short chain nonionic surfactants for use herein are those where e and p are such that e+p is from 3 to 10, particularly those where p is 0 and e is 3 to 8. Also, most preferred short chain nonionic surfactants for use herein are those where said short chain is a hydrocarbon chain comprising from 7 to 11 carbon atoms. Said preferred short chain nonionic surfactants for use herein can be manufactured by the processes well known to those skilled in the art, such as condensation of the corresponding alcohol and alkylene oxide, but such short chain surfactants are more conveniently commercially available for instance from Sidobre under the trade name Mergital®$C_4$ (C8EO4), from Kolb under the trade names Imbentin® AG/810/050 and AG/810/080 (respectively C8-10EO5 and C8-10EO8); from Shell under the trade name Dobanol 91-2.5®($C_9$–$C_{11}$ EO2.5), Dobanol 91-6® ($C_{9-11}$ EO6), Dobanol 91-4-6®, from Vista Chemicals under the trademark Vista 1012-52®, from EXXON under the trademark Asopol 91-4.6.

Another preferred class of short chain nonionic surfactants are secondary alcohol ethoxylates according to the formula:

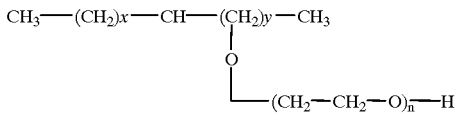

wherein (X+Y) is from 2 to 10 and the number of ethoxylate groups n is from 1 to 7. Example of commercially available surfactants of this type include the Tergitol S series from Union Carbide.

Preferred short chain anionic surfactants for use herein are $C_6$–$C_{11}$ alkyl sulfates and $C_6$–$C_{11}$ alkyl sulfonates, $C_6$–$C_{11}$ betaines, $C_6$–$C_{11}$ amine oxides and mixtures thereof. Most preferred are the $C_6$–$C_8$ alkyl sulfates and sulfonates. Such short chain anionic surfactants can be made by well known sulphation or sulphonation processes followed by neutralization, but said anionic short chain surfactants are more conveniently commercially available, for instance from Rhone Poulenc under the trade name Rhodapon® OLS, or from Witco under the trade name Witconate®.

Various nonlimiting examples of bleach activators suitable for use in the compositions of the present invention are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamidocaproyl) oxybenzenesulfonate, and mixtures thereof as described in U.S. Pat. No. 4,634,551, incorporated herein by reference.

In a preferred embodiment, the bleach activator is selected from the group consisting of amido-derived bleach activators, acylated citrate ester bleach activators, benzoxazin-type bleach activators, acyl lactum bleach activators, or mixtures thereof.

Another class of bleach activators comprise the acylated citrate ester described in U.S. Pat. No. 5409632. Preferred acylated citrate esters are of the formula

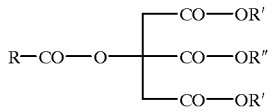

wherein R', R" and R'" are independently selected from the group consisting of H, $C_{1-18}$ alkyl, $C_{1-18}$ alkenyl, substituted phenyl, unsubstituted phenyl, alkylphenyl, and alkenylphenyl, and R is selected from the group consisting of $C_1$–$C_9$ alkyl, $C_1$–$C_9$ alkenyl, substituted phenyl, unsubstituted phenyl, alkylphenyl, and alkenylphenyl. Mixtures of acylated citrate esters are also included herein.

It is best for the efficiency and stability of the peracid precursors for the present invention that R', R" and R'" should not all be H in a given molecule. Preferably, R is $C_1$–$C_9$ alkyl, and R', R" and R'" are selected from the group consisting of H, $C_{1-4}$ alkyl, and $C_{1-4}$ alkenyl, but R', R" and R'" are not all H. Most preferably, R', R" and R'" are methyl or ethyl.

In the bleaching operation, the acylated citrate esters according to the present invention will react with hydrogen peroxide to yield peracids and citrate esters. The peracid generated depends on the R group which is chosen. Preferred substituted phenyls are sulphophenyls. Preferably, R is $C_{12}$–$C_9$ alkyl.

Though not preferred, it is also possible to use acylated citrates which are only partially esterified, i.e. R', R" or R'" or combinations thereof are H, the only proviso being that not all three of R', R" and R'" can be H in a given molecule. In the case where only one of R', R" and R'" is H, i.e. the acylated citrate ester is a diester, it is preferred to have a "central" diester, i.e. it is preferred that R" is not H. In the case where two of R', R" and R'" are H, i.e. the acylated citrate ester is a monoester, it is preferred to have a symmetrical monoester, i.e. a central monoester, i.e. it is preferred that R" is not H. In the case where monoesters are used, it is preferred that the ester chain be rather long, i.e. up to 18 carbon atoms.

Preferred acylated citrate esters are selected from the group consisting of acetyl triethyl citrate, octanoyl trimethyl citrate, acetyl trimethyl citrate, nonanoyl triethyl citrate, hexanoyl triethyl citrate, octanoyl triethyl citrate, nonanoyl trimethyl citrate, hexanoyl trimethyl citrate and mixtures thereof.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

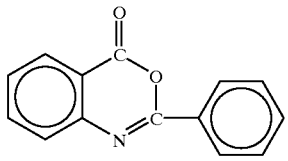

Still another class of preferred bleach activators includes the acyl lactam activators, especially acyl caprolactams and acyl valerolactams of the formulae:

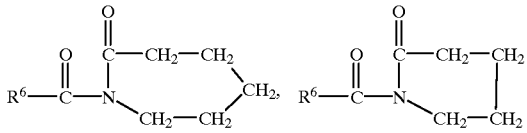

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Any alkaline materials are suitable for use in the present invention. Preferred alkaline materials are selected from the group consisting of potassium hydroxide, sodium hydroxide, ammonium hydroxide, ammonium silicate, sodium bicarbonate, borax, monoethanolamine borate, monoethanolamine triethanolamine, and mixtures thereof. In general the spot treating composition comprises from 0.1% to 10%, preferably 0.5% to 3% by weight of the alkaline material. Preferably the pH is greater than 8, more preferably greater than 9, and most preferably greater than 10. The pH of the neat compositions was measured by means of a portable pH meter from Knick (Portamess 752).

By "long-chain" what is meant herein is surfactants having an alkyl chain, the alkyl chain comprising 12, or more than 12 carbon atoms.

Non-limiting examples of long-chain surfactants useful herein include the conventional $C_{12}$–$C_{18}$ alkyl benzene sulfonates ("LAS") and primary, branched-chain and random $C_{12}$–$C_{20}$ alkyl sulfates ("AS"), the $C_{12}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{12}$–$C_{18}$ alkyl alkoxy sulfates ("$AE_xS$"; especially EO 1–7 ethoxy sulfates), $C_{12}$–$C_{18}$ alkyl alkoxy carboxylates (especially the EO 1–5 ethoxycarboxylates), the $C_{12-18}$ glycerol ethers, the $C_{12}$–$C_{18}$ alkyl polyglycosides and their corresponding sulfated polyglycosides the $C_{12}$–$C_{18}$ alpha-sulfonated fatty acid esters methyl ester sulphonate (MES), and oleyol sarcosinates. The conventional nonionic and amphoteric surfactants such as the $C_{12}$–$C_{18}$ alkyl ethoxylates ("AE") particulary preferred are $C_{12}$–$C_{16}$ fatty alcohol polyglycol ethers or ethoxylated primary alcohols with EO 2–7 (especially ethoxylates and mixed ethoxy/propoxy), $C_{12}$–$C_{18}$ betaines and sulfobetaines ("sultaines"), $C_{12}$–$C_{18}$ amine oxides, and the like, can also be included in the overall compositions. The $C_{12}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{12}$–$C_{18}$ N-(3-methoxypropyl) glucamide. The N-propyl through N-hexyl $C_{12}$–$C_{18}$ glucamides can be used for low sudsing. $C_{12}$–$C_{20}$ conventional soaps may also be used. If high sudsing is desired, the branched-chain $C_{12}$–$C_{16}$ soaps may be used. Mixtures of anionic and nonionic surfactants are especially useful. Other conventional useful surfactants are listed in standard texts.

A particularly preferred composition according to the present invention comprises from 5% to 50% by weight of a mixed nonionic system comprising first, short-chain nonionic surfactant and second, long-chain nonionic surfactant. More preferably the composition comprises from 10% to 40% by weight of the mixed nonionic surfactant, and most preferably from 15% to 30%. The nonionic system preferably has an overall HLB value of from 2 to 16, more preferably from 8 to 14, most preferably from 9 to 10. Furthermore it is preferred that the ratio of first surfactant to second surfactant is from 1:10 to 10:1, more preferably from 1:3 to 3:1, and most preferably about 1:1.

The detergent composition of the present invention is useful in various known and conventional cleaning methods. However a preferred cleaning method comprises the steps of applying the detergent composition to the spot or stain; placing an absorbent layer adjacent to the textile fabric in the region of the spot or stain; and applying heat, pressure, or heat and pressure to the textile fabric in the region of the spot or stain; so that some or all of the spot or stain is absorbed into the absorbent layer.

A still more preferred cleaning method comprises the steps of (a) applying the detergent composition to a spot or stain and placing an absorbent layer adjacent to the textile fabric in the region of the spot or stain and a first means for transferring some or all of the spot or stain into the absorbent layer; optionally also applying a peroxide bleaching agent and subsequently (b) applying a hydrophilic solvent or water, to the textile fabric in the region of the spot or stain and placing an absorbent layer adjacent to the textile fabric in the region of the spot or stain and the step of applying heat to the textile fabric in the region of the spot or stain. The application of heat or pressure, or both, may be achieved by any means, but is most preferably achieved by a hand-held device such as an iron. A conventional iron having a hot-plate fixed to a body is a highly preferred hand held device. The hot-plate is heated most commonly by electrical means, and may have a means for controlling the temperature. A supply of water or steam may also be provided by the iron. Most preferably the absorbent layer is placed on a flat surface, such as an ironing board, and the stained or soiled textile fabric is laid flat on top of, and in contact with, the absorbent layer. The iron can then be easily applied to the textile fabric in the region of the stain or spot in order to ensure complete, or substantially complete, transfer of the stain or spot into the absorbent layer. The iron is preferably operated at a temperature of from 40° C. to 200° C., more preferably from 40° C. to 180° C.

An alternative device for applying heat or pressure is a heated roller or any other heated applicator. The roller or applicator may also be provided with a supply of the detergent composition.

Suitable applicators include a steam iron with suction brush attachment, such as that disclosed in EP-A-0 493 348, and a thermoelectric applicator, such as that disclosed in EP-A-0 552 397. Also suitable is a steam iron with atomiser, such as that disclose in EP-A-0 629 736 wherein the detergent composition may optionally be stored in the iron and delivered directly onto the textile fabrics by means of the atomiser.

Without wishing to be bound by theory it is believed that hydrophobic stains are first rendered hydrophilic by applying a detergent composition, optionally with a gentle rubbing action. Greasy stains which contain hydroxyl groups are deprotoneated at high pH and are thus rendered more easy to solubilize in the detergent solution. Higher pH can also induce soll peptization on some food stains. The stains are in effect broken down, and rendered easier to remove. The benefits of high pH can be particularly observed when before or after application of the detergent composition, another composition containing a bleaching species is applied on the stain. Indeed, conventional peroxide bleaching technologies have an increased reactivity with pH. Water is then applied to the stain, again, optionally with a gentle rubbing action. The stain is removed by laying the stained fabric adjacent to an absorbent layer. The stain, which has been rendered more hydrophilic by the treatment, is transferred to the absorbent layer.

Textile fabrics are any materials made from cloth, including garments such as shirts, blouses, socks, skirts, trousers, jackets, underwear etc, and also including tablecloths, towels, curtains etc. The definition of textile fabrics as used herein does not include carpets and similar floor coverings.

Textile fabrics which are to be used in the present invention are commonly made by weaving or knitting. Many different fibres may be used to produce woven, knitted or other types of textile fabric including synthetic fibres (such as polyester, polyamide, etc.) and natural fibres from plants (such as cotton, hemp) and from animals (such as wool, angora, silk). Blends of different fibres are also commonly used.

EXAMPLES

In the examples, all compositions are expressed as % by weight (unless otherwise stated).

In the examples, Shellsol® is a mixture of C8–C11 isoparaffins with 5% aliphatic C7 ester.

Dobanol® is a ethoxylated primary alcohol with an average of 3EO, supplied by Shell.

Lutensol AE21® is C13–15 ethoxylated alcohol with an average of 21EO.

Dehydol® is a fatty alcohol polyglycol ether octyl with an average of 4EO, supplied by Henkel.

Alkyl sulphate, C6AS, has an average of 6 carbon atoms in the alkyl chain.

DTPMP is diethylene triamine penta methylene phosphoric acid.

| | Example 1 | Example 2 | Example 3 | Example 4 |
|---|---|---|---|---|
| Shellsol ® | 20 | — | 20 | 20 |
| D-Limonene | — | 24 | — | — |

-continued

| | Example 1 | Example 2 | Example 3 | Example 4 |
|---|---|---|---|---|
| Sodium paraffin sulphonate | 0.2 | 0.4 | 0.2 | 0.2 |
| Dobanol 23-3 ® | 0.2 | 0.4 | 0.2 | 0.2 |
| Dobanol 25-3 ® | 5 | 10 | 5 | 5 |
| Lutensol AE21 ® | 0.3 | 0.6 | 0.3 | 0.3 |
| Dehydol C8EO4 ® | 5 | 10 | 5 | — |
| C6AS | — | — | — | 5 |
| Sodium hydroxide | 3.1 | 6.2 | — | 3.1 |
| Monoethanolamine | — | — | 3 | — |
| Sodium carbonate | 0.7 | 1.4 | — | — |
| Sodium bisulfite | — | — | 1 | — |
| Citric acid | 3 | 6 | — | 3 |
| DTPMP | 0.75 | 1.5 | — | 0.75 |
| Acetyl Triethyl Citrate | 2 | 4 | 2 | 2 |
| Water | Balance | Balance | Balance | Balance |

In Example 4 the C6-AS was replaced in turn by C8-LAS, C8-ethylhexyl AS, C8-octylsulphonate, C8 dimethylamine oxide, C71EO6.5 and sodium cumene sulphonate.

All of the compositions of the examples had a final pH of 10.

A set of polycotton swatches (50 mm square) were soiled with make-up, chocolate sauce and tomato sauce. The stain was left to age for a day, in the dark, at normal room temperature (c.a. 20° C., 60% RH). Each soiled swatch was cleaned by the following method:

1. The stained area was placed directly upon a strip of absorbent paper (the paper used was the absorbent core of a diaper).
2. 1 ml of the composition of Example 1 was dripped on to the stained area.
3. The stained area was brushed with a conventional electrical toothbrush for 10 seconds (the toothbrush used, a Braun® dental d3, was one normally intended for daily oral care).
4. 1 ml of the peroxide composition of example 5 was dripped onto the stained area and the stained area was again brushed with the toothbrush.
5. Pressure and heat were applied using an iron set at a temperature of 140° C. for 10 seconds. A typical ironing pressure, as normally used for removing wrinkles in fabrics, was used.
6. 1 ml of distilled water was dripped onto the stained area.
7. Step 5. was repeated followed by the further addition of 2 ml of distilled water.
8. The swatch was dried and smoothed.

The method of cleaning was repeated on stained swatches using the compositions of Examples 2 to 4 in place of the composition of Example 1.

Example 5

Peroxide Composition

| | |
|---|---|
| C10 alkyl sulphate | 1.2 |
| Dobanol 23-3 ® | 1.1 |
| Dobanol 91-10 ® | 1.6 |
| Polyvinyl pyrrolidone | 0.2 |
| Hydrogen peroxide | 6.8 |
| IsoFol 12 ® | 0.5 |

-continued

| | |
|---|---|
| DTPMP | 0.2 |
| Sulphuric acid | to pH 4 |
| Water | to balance |

IsoFol 12 ® is 2 butyloctanol from Condea.

We claim:

1. A microemulsion cleaning composition having a pH greater than 10 which is an oil-in-water or water-in-oil microemulsion, comprising:

(i) from 5% to 25% of a non-aqueous hydrophobic solvent selected from the group consisting of deodorised kerosene, chlorinated hydrocarbons, 1,1,1-trichloroethane, perchloroethylene, methylene chloride, ethylene glycol monoethyl ether, propylene glycol monomethyl ether, 2-butoxy ethanol, butyl diethylene glycol ether ethanol, butoxytriglycol, butylene glycol, hexylene glycol, and propyl propanol;

(ii) at least 5% of a first anionic or nonionic surfactant; characterised in that the cleaning composition further comprises (iii) a bleach activator present in an amount in a range of from 0.1% to 10% by weight, wherein said bleach activator is selected from the group consisting of amido-derived bleach activators of the formulae selected from the group consisting of $R^1N(R^5)C(O)R^2C(O)L$ or $R^1C(O)B(R^5)R^2C(O)L$ wherein $R^1$ is an alkyl group containing from about 6 to about 12 atoms, $R^2$ is an alkylene containing from 1 to about 6 carbon atoms, $R^5$ is H or alkyl, aryl, or alkaryl containing from about 1 to about 10 carbon atoms, and L is a leaving group, acylated citrate ester bleach activators, benzoxazin bleach activators, acyl lactum bleach activators, and mixtures thereof and 5% to 95% water.

2. A cleaning composition according to claim 1 wherein the first surfactant has an alkyl chain, the length of the alkyl chain being C11 or less; and further comprising (iv) second surfactant having an alkyl chain, the length of the alkyl chain being $C_{12}$ or more.

3. A cleaning composition according to claim 2 wherein the second surfactant is selected from the group consisting of $C_{12}$–$C_{16}$ fatty alcohol polyglycol ethers and ethoxylated primary alcohols with 2 to 7 ethoxylation.

4. A cleaning composition according to claim 2 comprising from 5% to 50% by weight of a mixed nonionic surfactant system comprising the first and second surfactants, the mixed nonionic surfactant system having an overall HLB value of from 2 to 16.

5. A cleaning composition according to claim 2 wherein the molar ratio of first surfactant to second surfactant is from 1:10 to 10:1.

6. A cleaning composition according to claim 1 wherein the first surfactant is selected from the group consisting of $C_6$–$C_{11}$ alkyl alkoxylates according to the formula $C_6$–$C_{11}(OCH_2CH_2)_e(OCH(CH_3)CH_2)_pOH$ where e+p ranges from 3 to 10, $C_6$–$C_{11}$ secondary alcohol ethoxylates, $C_6$–$C_{11}$ alkyl sulphonates, $C_6$–$C_{11}$ alkyl sulphates, $C_6$–$C_{11}$ amine oxides, and mixtures thereof.

* * * * *